United States Patent [19]

Ueyama et al.

[11] Patent Number: 4,872,435

[45] Date of Patent: Oct. 10, 1989

[54] THROTTLE VALVE CONTROLLING APPARATUS INCLUDING RELATIVE POSITION LIMITING MEANS FOR THROTTLE VALVES

[75] Inventors: Yoshiji Ueyama; Yoshiaki Asayama, both of Hyogo, Japan

[73] Assignee: Mitsubishi Denki Kabushiki Kaisha, Tokyo, Japan

[21] Appl. No.: 236,823

[22] Filed: Aug. 26, 1988

[30] Foreign Application Priority Data

Aug. 26, 1987 [JP] Japan ..... 62-212531

[51] Int. Cl.[4] ..... F02M 11/04

[52] U.S. Cl. ..... 123/336

[58] Field of Search ..... 123/336, 342, 403

[56] References Cited

U.S. PATENT DOCUMENTS 4,445,474 5/1984 Nakau et al. ..... 123/336

4,688,533 7/1987 Olobe ..... 123/336

4,757,796 7/1988 Jimenaz ..... 123/336

4,805,572 2/1989 Fujita et al. ..... 123/336

*Primary Examiner*—Raymond A. Nelli

*Attorney, Agent, or Firm*—Sughrue, Mion, Zinn, Macpeak and Seas

[57] ABSTRACT

In a throttle valve controlling apparatus, there is provided a pair of first and second throttle valves. The first throttle valve is rotated by an electrically controlled actuator, whereas the second throttle valve is rotated by an accelerator pedal. A relative position limiting device is interposed between the electrically controlled actuator and a calculation/controlling unit. This calculation/controlling unit enables the electrically controlled actuator to be controlled by transferring a rotation command signal. When the calculation/controlling unit is brought into malfunction, the relative position limiting device interrupts supply of the rotation command signal from the calculation/controlling unit to the electrically controlled actuator, so that the first throttle valve is forcibly returned to its fully close position by means of a return spring.

9 Claims, 6 Drawing Sheets

THROTTLE VALVE CONTROLLING APPARATUS INCLUDING RELATIVE POSITION LIMITING MEANS FOR THROTTLE VALVES

BACKGROUND OF THE INVENTION

1. Field of the Invention

The present invention generally relates to a control apparatus for a throttle valve of an automobile engine. More specifically, the invention is directed to an apparatus for controlling a pair of throttle valves, one of which is electronically controlled by an electrically controlled actuator and the other of which is mechanically controlled by an accelerator pedal.

2. Description of the Related Art

In recent years, as means for controlling the engine to improve the exhaust emission controlling performance and fuel consumption performance, there has been developed a throttle valve controlling apparatus using an electrically controlled actuator in which a throttle valve and an accelerator pedal are not mechanically coupled, but the opening and closing of the throttle valve are controlled based upon a control signal. This control signal is obtained by converting an accelerator pedal operating amount into an electric signal (this signal is referred to as "an accelerator pedal operating amount signal") and signals indicative of the other engine operating state or vehicle running state, for instance, these signals include an engine revolution speed signal, a gear position signal, and the like.

The throttle valve is opened and closed by a throttle valve drive motor. This motor operates in accordance with a command which is input from a vehicle controlling apparatus consisting of a calculation/controlling unit to sequentially calculate the optimal opening degree in correspondence to the engine operating state or vehicle running state. Therefore, it is necessary to provide a fail-safe device to prevent the runaway of the vehicle even if the electrically controlled actuator including the drive motor is made inoperative during the running of the vehicle. As a conventional example having such a fail-safe device, there has been disclosed a specific construction in Japanese Patent Publication No. 58-25853 (1983). That is, the electromagnetic clutch is employed to disconnect the throttle valve shaft from the drive motor when the engine becomes uncontrollable, and the return spring to fully close the throttle valve when the electromagnetic clutch is in the inoperative mode, is attached to the throttle valve shaft. On the other hand, in Japanese Patent Disclosure (KOKAI) No. 61-215436, there has also been disclosed the apparatus in which the throttle valve shaft is mechanically rotated through a differential gear device in response to a control amount of the electrically controlled actuator or an operating amount of the accelerating pedal.

However, according to such conventional apparatuses, when the electrically controlled actuator is once made inoperative, there is another problem such that the runaway of the vehicle cannot be avoided even if the electrically controlled actuator is normally operable, but the calculation/controlling unit for controlling this actuator is brought into the uncontrollable condition.

When the throttle valve is returned to the fully closed position due to a failure or abnormality of an electrically controlled actuator and/or calculation/controlling unit provided in a conventional throttle valve controlling apparatus, although the runaway of the vehicle can be prevented, there is a still problem such that the continuous driving of the vehicle cannot be maintained and thus the vehicle cannot be moved to a repair shop.

The present invention is made to solve the foregoing problems and it is an object of the invention to obtain a throttle valve controlling apparatus of an engine in which even if an electrically controlled actuator and/or calculation/controlling unit is brought into malfunction, the runaway of the vehicle can be prevented, and even during such a malfunction the vehicle can be continuously driven (i.e., so-termed "limp home" driving). That is, an object of the invention is to obtain a throttle valve controlling apparatus which can execute such a limp home drive of the vehicle.

SUMMARY OF THE INVENTION

The above and other objects of the invention are realized by utilizing a throttle valve controlling apparatus for an automobile comprising:

a throttle valve device including a first throttle valve (4) and a second throttle valve (2) relatively rotatable to said first throttle valve (4), for controlling a flow of an air/fuel mixture to an engine of the automobile;

a rotating device (7;8) mechanically coupled to an accelerator pedal (9), for relatively rotating said first throttle valve (4) with respect to said second throttle valve (2);

a first return spring (10) for biasing said first throttle valve (4) so as to set the same to a first closed position of said first throttle valve (4) when said accelerator pedal (9) is released;

a rotation angle sensor (28) for sensing an actual rotation angle ($\theta_R$) of said second throttle valve (2) to output a rotation angle signal (RA);

a calculation/controlling circuit (27) for producing a rotation command signal (D) representative of a target rotation angle ($\theta_T$) for said second throttle valve (2), determined by operation of said accelerator pedal (9);

an electrically controlled actuator (13) for relatively rotating said second throttle valve (2) with respect to said first throttle valve (4) in response to said rotation command signal (D) derived from said calculation/controlling circuit (27) in such a manner that deviation between said target rotation angle ($\theta_T$) and actual rotation angle ($\theta_R$) becomes zero;

a second return spring means (16) for biasing said second throttle valve (2) so as to set the same to a second closed position of said second throttle valve (2); and, a relative position limiting device (50) interposed between said electrically controlled actuator (13) and said calculation/controlling circuit (27), for limiting a relative position between said first and second throttle valves (4;2) within a predetermined rotation range in such a manner that when malfunction of said calculation/controlling circuit 27 is detected by checking said relative position in said relative position limiting device (50), supply of said rotation command signal from said calculation/controlling circuit (27) via said relative position limiting device (50) to said electrically controlled actuator (13) is interrupted.

BRIEF DESCRIPTION OF THE DRAWINGS

The invention will be more readily understood on reading the following description with reference to the accompanying drawings, in which.

DETAILED DESCRIPTION OF THE PREFERRED EMBODIMENTS BASIC IDEA

Before describing various preferred embodiments according to the invention, a basic idea of the invention will now be summarized.

In the throttle valve controlling apparatus of the invention, first and second throttle valves are provided so as to be relatively rotatable. The second throttle valve is mechanically coupled to an accelerator pedal, thereby controlling this throttle valve. The first throttle valve is connected to an electrically controlled actuator, thereby controlling this throttle valve. The electrically controlled actuator is communicated to a calculation/controlling unit for calculating/controlling various kinds of driving information data of a vehicle through a device for limiting the relative position of the first and second throttle valves within a predetermined range. A flow rate (amount) of the intake air to the engine is controlled by changing the relative position between the first and second throttle valves, i.e., the relative opening degree or angle. Therefore, for instance, even when the second throttle valve coupled with the electrically controlled actuator is returned to the fully closed position, the intake air flow rate can be controlled by controlling only the first throttle valve, using an accelerator pedal. Thus, the driving of the vehicle can be continued under the "limp home" mode.

According to the throttle valve controlling apparatus of the invention described above, during the normal condition, the relative opening degree between the first and second throttle valves is controlled on the basis of both one rotation position controlled by the electrically controlled actuator and the other rotation position controlled by the driving means (accelerator pedal). On the other hand, if the calculation/controlling unit is brought into malfunction and therefore the first throttle valve is driven by the electrically controlled actuator in such a direction as to extraordinarily open the controlled rotation position of the first throttle valve, when this rotation position is set to a predetermined position or more to the rotation position controlled by the accelerator pedal, the means for limiting the relative rotation position within a predetermined range is made operative. Thus, the operation of the first throttle valve by the electrically controlled actuator is stopped irrespective of an output signal of the calculation/controlling unit which would be supplied to the electrically controlled actuator, only the second throttle valve is controlled by the accelerator pedal, and thereby enabling the engine speed to be controlled under the limp home mode.

CONSTRUCTION OF THROTTLE VALVE CONTROLLER

Figure 1:
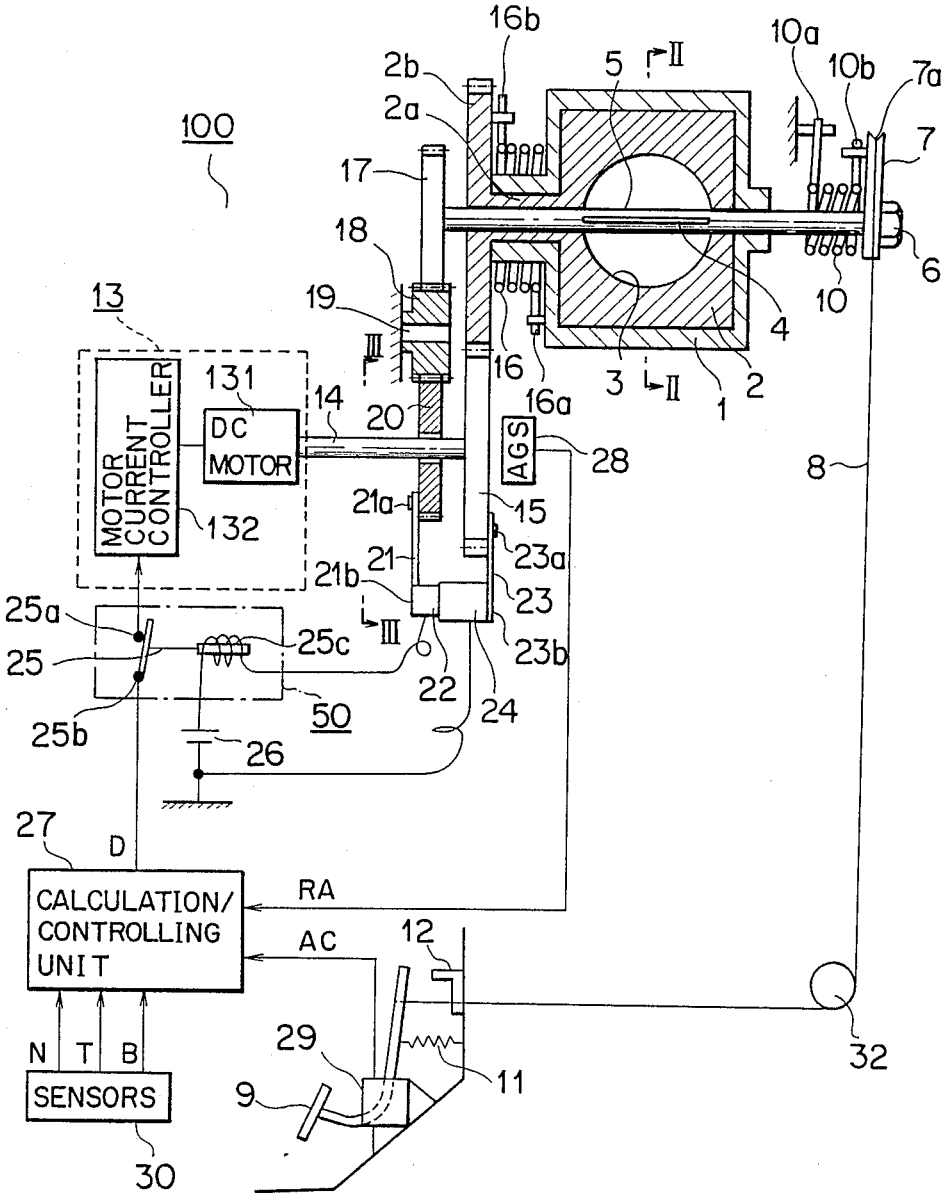
FIG. 1 schematically shows a throttle valve controlling apparatus 100 according to a first preferred embodiment of the invention.
Figure 2:
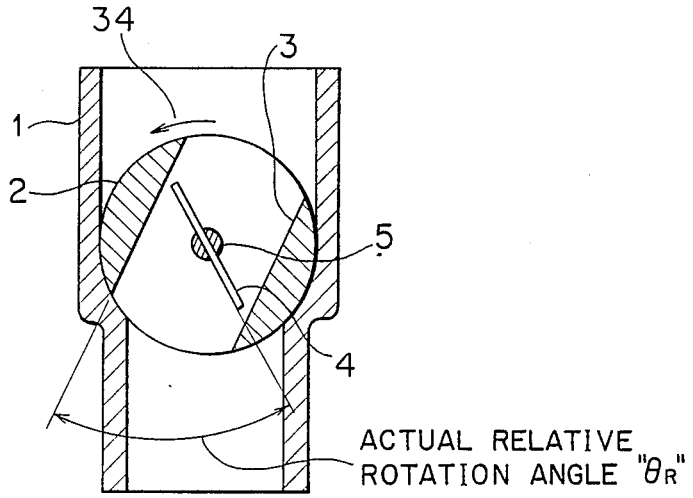
FIG. 2 is a sectional view of the first and second throttle valves, taken along a line II—II of FIG. 1.
Figure 3:
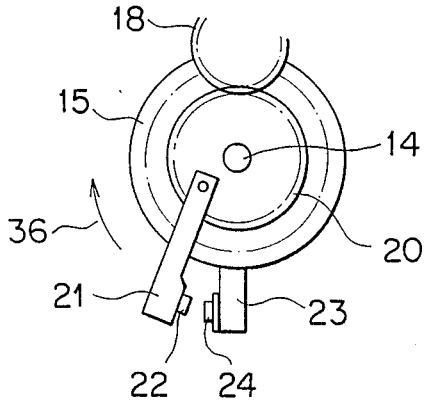
FIG. 3 is a sectional view of the first and second contacts, taken along a line III—III of FIG. 1.

Referring now to FIGS. 1 to 3, a construction of a throttle valve controlling apparatus 100 accomplished based upon the above-described basic idea, according to one preferred embodiment of the invention, will now be described.

FIG. 1 schematically illustrates the construction of the throttle valve controlling apparatus 100, FIG. 2 is a sectional view of the first and second throttle valves, taken along a line II—II of FIG. 1, and FIG. 3 is another sectional view of the first and second arms having the first and second contacts, taken along a line III—III of FIG. 1.

The throttle valve controlling apparatus 100 and its peripheral arrangement are constructed by the following components.

Reference numeral 1 denotes an air-intake pipe of an engine of an automobile (not shown). A first throttle valve 2 has a cylindrical shaft portion 2*a* supported to the air-intake pipe 1 and is rotatably attached in the pipe 1. The first throttle valve 2 has also a cylindrical path 3 through which the sucked air to the engine passes. A second throttle valve 4 is coaxially employed with the first throttle valve 2 and constitutes a pair of throttle valves in conjunction with the first throttle valve 2. The second throttle valve 4 is a disk-like shape and opens and closes the cylindrical path 3 of the first throttle valve 2. A valve shaft 5 for the second throttle valve 4 is supported to the air-intake pipe 1 and penetrates through the cylindrical shaft portion 2*a* of the first throttle valve 2, and furthermore opens and closes the second throttle valve 4. An accelerator wire 8 is wound around a groove 7*a* of a segment-shaped disk 7 fixed to the valve shaft 5 by a bolt 6. The wire 8 is coupled with an accelerator pedal 9 through a pulley 32. A first coil-shaped return spring 10 is provided to apply tension to the wire 8. One end 10*a* of the return spring 10 is fixed to a portion of the air-intake pipe 1 and the other end 10*b* thereof is fixed to the disk 7. The second throttle valve 4 is biased to the fully closed position (which will be explained hereinlater) by the first return spring 10. A second return spring 11 and also a stopper 12 for the accelerator pedal 9 are also provided.

An electrically controlled actuator 13 comprises a DC drive motor 131, and a motor current controlling circuit 132 to supply a current to the DC motor 131. A rotary shaft 14 is coupled wit a motor-sided gear 15. The first throttle valve 2 is rotated in a predetermined direction by the drive motor 131 through the motor-sided gear 15 meshed with a gear 2*b* coupled with the cylindrical shaft portion 2*a* of the first throttle valve 2 and through the rotary shaft 14. Reference numeral 16 denotes a third coil-shaped return spring. One end 16*a* of the return spring 16 is fixed to the air-intake pipe 1 and the other end 16*b* thereof is fixed to the gear 2*b*. The first throttle valve 2 is biased to the fully closed position by this third return spring 16. It should be noted that similarly in the first embodiment shown in FIGS. 1 to 4, the first throttle valve 2 is controlled by the electrically controlled actuator 13 whereas the second throttle valve 4 is controlled by the accelerator pedal 9.

Reference numeral 17 denotes a gear coupled with the valve shaft 5; 18 indicates an intermediate gear which is come into engagement with the gear 17 and is rotatably attached to a pin 19 fixed to the air-intake pipe 1; 20 is a pedal-sided gear which is rotatably attached to the rotary shaft 14 and is in engagement with the intermediate gear 18; 21 a first arm in which one end 21*a* is fixed to the pedal-sided gear 20 and the other end 21*b* is connected to a pedal-sided contact 22 (see FIG. 3); and 23 a second arm in which one end 23*a* is fixed to the motor-sided gear 15 and the other end 23*b* is connected to a motor-sided contact 24 (see FIG. 3). The pedal-sided contact 22 and motor-sided contact 24 of the first and second arms 21 and 23 are arranged so as to face each other (will be discussed in more detail later).

RELATIVE POSITION LIMITING MEANS

Reference numeral 25 denotes an electromagnetic relay which together with the contacts 22 and 24, constructs means 50 for limiting the relative position between the motor-sided gear 15 and the pedal-sided gear 20. Reference numeral 26 denotes a power source for energizing the relay 25. When the pedal-sided contact 22 electrically touches the motor-sided contact 24, the electromagnetic relay 25 is made operative (opened), thereby stopping the supply of a rotation command signal "D" from a calculation/controlling unit 27 so as to control the electrically controlled actuator 13. The relative position limiting means 50 according to the preferred embodiment comprises the contacts 22 and 24, electromagnetic relay 25, and energizing power source 26. That is, when the actuator 13 and/or calculation/controlling unit 27 fails, the contacts 22 and 24 are electrically connected, thereby opening normally-closed contacts 25*a* and 25*b* of the relay 25. Thus, the rotation command signal D is not supplied from the calculation/controlling unit 27 to the actuator 13. Consequently, the operation of the actuator 13 is interrupted. The first throttle valve 2 is forcibly returned to the fully closed position from the present operative position by the spring force of the third return spring 16. At the fully closed position of the first throttle valve 2, the intake air amount suddenly decreases. However, since the second throttle valve 4 can be independently controlled by the accelerator pedal 9 though the operation of the first throttle valve 2 is still stopped, under the "limp home" drive mode.

The calculation/controlling unit 27 receives: an output signal "RA" of a rotation angle sensor 28 to detect a rotation angle of the motor-sided gear 15, i.e., the signal representative of the rotation angle of the first throttle valve 2; an output signal (i.e., accelerator pedal operating amount signal) "AC" of an acceleration sensor 29 to detect an operating amount of the accelerator pedal 9 which is operated by the car driver; and output signals "N", "T", and "B" of drive condition sensors 30 to detect the operating conditions (for instance, a rotation speed "N" and a gear-changing timing "T" of an automatic change gear) of the engine and the operating condition (e.g., a braking operation "B") of the vehicle. The calculation/controlling unit 27 executes the predetermined calculating processes in response to those input data and controls the DC drive motor 131 through the motor current controlling circuit 132. In this case, since the contacts 25*a* and 25*b* of the relay 25 as a part of the relative position limiting means 50 are normally closed, the rotation command signal D from the calculation/controlling unit 27 is supplied to the motor current controller 132 of the actuator 13. Thus, the first throttle valve 2 can be controlled.

NORMAL OPERATION OF THROTTLE VALVE CONTROLLER

The normal operation of a throttle valve controlling apparatus 100 shown in FIG. 1 in the preferred embodiment will now be described with reference to FIGS. 1 to 3.

First, since the throttle valve controlling apparatus 100 executes the normal operation, the pedal-sided contact 21*b* of the first arm 21 fixed to the pedal-sided gear 20 does not electrically make in contact with the motor-sided contact 23*b* of the second arm 23 fixed to the motor-sided gear 15. Therefore, the contact 25*a* of the relay 25 for limiting the relative position is being closed. Thus, the rotation of the first throttle valve 2 is completely controlled by the actuator 13.

Under these conditions, the rotational driving force of the DC drive motor 131 is transferred from the gear 2*b* to the cylindrical shaft portion 2*a* through the motor-sided gear 15, thereby rotating the first throttle valve 2 against the spring force of the third return spring 16. On the other hand, the second throttle valve 4 is opened or closed through the accelerator wire 8, pulley 32, disk 7, and valve shaft 5 in accordance with the operating amount of the accelerator pedal 9 by a car driver. When an actual relative rotation angle "$\theta_R$" between the first and second throttle valves 2 and 4 shown in FIG. 2 increases, the area of the air passage in the cylindrical path 3 becomes narrow, so that the flow rate of the air which is sucked into the engine decreases. For the throttle valve apparatus (i.e., a pair of first and second throttle valves 2 and 4) which operates in this manner, the calculation/controlling unit 27 calculates a target valve rotation angle "$\theta_T$" of the first throttle valve 2 from the various information (e.g., the accelerator pedal operating amount "AC" and rotational speed signal "N") of the acceleration sensor 29 and sensors 30. Then, the calculation/controlling unit 27 outputs the rotation command signal D through the contact 25*b* of the relay 25 to the actuator 13 so that the difference between the calculated target valve rotation angle $\theta_T$ and the actual rotation angle $\theta_R$ which is derived from the output signal RA of the rotation angle sensor 28 becomes zero.

The above operation will now be described more in detail hereinbelow. When the rotation command signal D generated on the basis of the target valve rotation angle $\theta_T$ of the first throttle valve 2 which had been calculated by the calculation/controlling unit 27 is supplied to the motor current controlling circuit 132, the first throttle valve 2 is rotated by the motor 131 in the direction indicated by an arrow 34 in FIG. 2. The actual rotation angle of the valve 2 at this time can be acquired by continuously monitoring the output signal RA of the rotation angle sensor 28 in the calculation/controlling unit 27. In this manner, the rotation angle of the first throttle valve 2 is calculated on the basis of the output signal RA by the unit 27. The rotation command signal D is supplied from the unit 27 to the motor current controlling circuit 132 in such a manner that the difference between the actual rotation angle of the first throttle valve 2 obtained in this manner and the target valve rotation angle $\theta_T$ becomes zero. In other words, a feedback path for controlling the rotation of the first throttle valve 2 is formed by the calculation/controlling unit 27, motor current controlling circuit 132, DC drive motor 131, and rotation angle sensor 28. It should be noted that in the normal operating state, as shown in FIG. 3, the target valve rotation angle of the first throttle valve 2 is determined such that the pedal-sided contact 22 is not in contact with the motor-sided contact 24.

MALFUNCTION OF ELECTRICALLY CONTROLLED ACTUATOR

When the DC drive motor 131 or motor current controlling circuit 132 of the electrically controlled actuator 13 shown in FIG. 1 is brought into malfunction and the rotating operation of the motor-sided gear 15 corresponding to the rotation command signal D of the calculation/controlling unit 27 becomes abnormal, that is, when the output signal RA of the rotation angle sensor 28 becomes abnormal, in response to this abnormal signal, the unit 27 soon supplies an abnormality stop signal to the actuator 13 to thereby interrupt the operation of the actuator 13. Thus, the first throttle valve 2 is forcibly returned to the fully closed position by the third return spring 16, that is, in the direction so as to increase the actual relative rotation angle $\theta_R$ shown in FIG. 2. Thereafter, the actual relative rotation angle $\theta_R$ is controlled by only the second throttle valve 4 which is mechanically coupled with the accelerator pedal 9 and operated thereby and the driving of the vehicle is continued.

According to the embodiment, there is a feature such that even if the actuator 13 fails as mentioned above, the runaway of the vehicle can be prevented and the driving of the vehicle called as a limp home drive can be certainly continued.

MALFUNCTION OF CALCULATION/CONTROLLING UNIT

As a major feature of the invention, countermeasures of the throttle valve controlling apparatus 100 for a failure of the calculation/controlling unit 27 will now be described in detail hereinbelow.

When the calculation/controlling unit 27 is brought into malfunction or fails due to interference radio waves or the like, and then the unit 27 generates the rotation command signal D by which the first throttle valve 2 is extraordinarily opened in the direction indicated by the arrow 34 in FIG. 3, the motor-sided gear 15 is abnormally rotated, so that the relative position with respect to the pedal-sided gear 20 changes and the motor-sided contact 24 touches the pedal-sided contact 22 (which will be explained in detail later). Therefore, the relay 25 operates to interrupt the supply of the rotation command signal D from the unit 27 which is electrically controlling the actuator 13. Thus, the rotation controlling operation of the first throttle valve 2 by the actuator 13 is interrupted and the first throttle valve 2 is forcibly returned to the fully closed position by the third return spring 16. That is, the first throttle valve 2 cannot be opened to the rotational position at which the contacts 22 and 24 touch with each other. When the accelerator pedal 9 is returned, the pedal-sided contact 22 is also rotated in the direction so as to close the second throttle valve 4, so that the position at which the contacts 22 and 24 are in contact with each other, is also rotated and moved in the direction so as to close the first throttle valve 2.

RELATIVE ROTATIONS OF CONTACTS 23 AND 24

The relative rotation of the motor-sided contact 24 and pedal-sided contact 23 will now be described in detail hereinbelow.

Figure 4A:
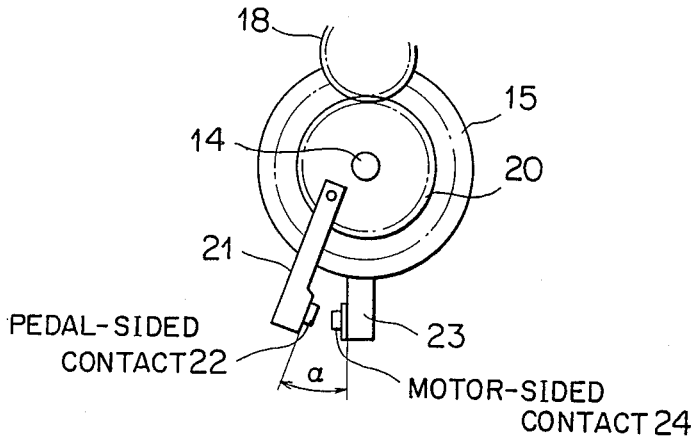
FIGS. 4A through 4D illustrate how the motor-sided contact and pedal-sided contact are operated.

First, FIG. 4A illustrate a first condition in which the first and second throttle valves 2 and 4 are set to the fully closed positions. In this state, the motor-sided contact 24 of the second arm 23 fixed to the gear 15 on the side of the motor 131 of the actuator 13 and the pedal-sided contact 22 of the first arm 21 mounted to the gear 20 on the side of the accelerator pedal 9 are separated away from each other at a predetermined angle "$\alpha$". Thus, the abnormally-closed type contacts 25*a* and 25*b* of the relay 25 as a part of the relative position limiting means 50 for the first and second throttle valves 2 and 4 are closed. This is because the calculation/controlling unit 27 is in the normal operation.

Figure 4B:
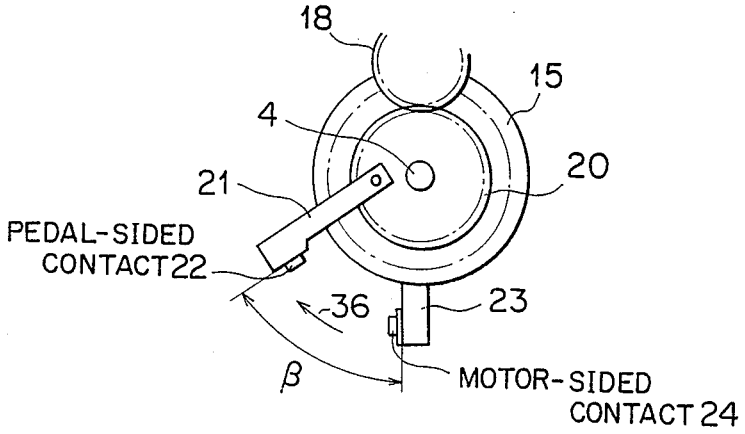

Secondly, FIG. 4B shows a second condition under which only the second throttle valve 4 coupled with the accelerator pedal 9 is moved to the fully opened position. In this state, the pedal-sided contact 22 is positioned apart from the motor-sided contact 24 at an angle $\beta$, which is considerably larger than the angle $\alpha$ in FIG. 4A.

Figure 4C:
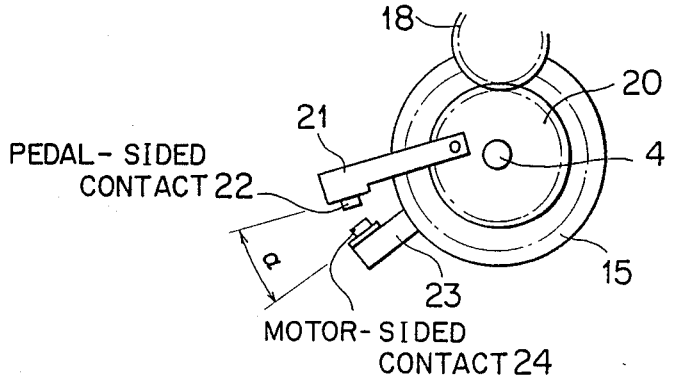
Figure 4D:
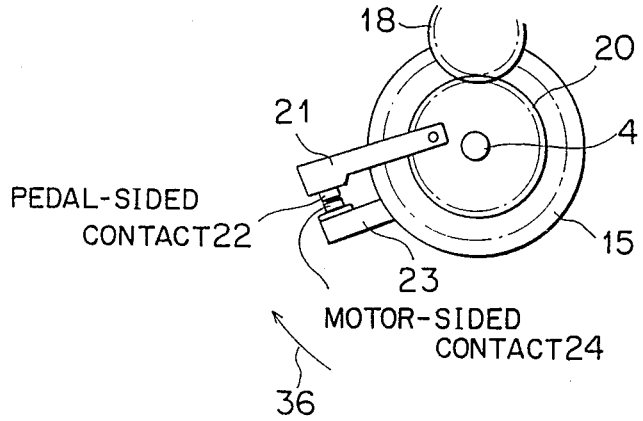

Further, FIG. 4C shows a third condition in which both of the first and second throttle valves 2 and 4 are moved to the fully opened positions. Even in this state, the pedal-sided contact 22 and motor-sided contacts 24 are still separated from each other with maintaining a predetermined minimum separating angle $\alpha$.

The foregoing contacting conditions shown in FIGS. 4A to 4C relate to the case where the calculation/-controlling unit 27 is operated under the normal condition.

States of the contacts 22 and 24 when the calculation/controlling unit 27 is brought into malfunction will now be described in detail.

First, as shown in FIG. 4B, in the state in which only the second throttle valve 4 coupled with the accelerator pedal 9 is fully open, if the unit 27 is brought into malfunction due to the reception of interference radio waves, the following operations are executed. That is, the rotation command signal D which is supplied from the unit 27 to the actuator 13 becomes abnormal, so that the motor 131 abnormally rotates and the motor-sided gear 15 connected to the rotary shaft 14 abnormally rotates. Consequently, the motor-sided contact 24 rotates in the direction of the arrow 36 and electrically touches the pedal-sided contact 22 which has already stopped at the fully opened position (see FIG. 4D).

Therefore, the energizing coil 25*c* of the relay 25 is energized by the energizing power source 26 through the electrically connected contacts 22 and 24. As a result, the normally-closed type contacts 25*a* and 25*b* of the relay 25 are opened, so that the rotation command signal D generated from the unit 27 cannot be supplied via this relay's contacts 25*a* and 25*b* to the motor current controlling circuit 132 of the actuator 13. Since the rotational force of the motor 131 is not applied via the gears 15, 26 to the first throttle valve 2 any more, the valve 2 is forcibly returned to the fully closed position by the third return spring 16. That is, the state of FIG. 4B is again established. In this case, since the rotation of the second throttle valve 4 coupled with the accelerator pedal 9 can be controlled independently of the stop motion of the first throttle valve 2, the driving of the vehicle itself can be continued. This driving state is referred to as the limp home drive mentioned above.

In this embodiment as well, since the first throttle valve 2 is forcibly returned to the fully closed position under the abnormal condition, there is a feature such that the risk of the runaway of the vehicle can be avoided. On the other hand, when the car driver operates the accelerator pedal 9, not only the second throttle valve 4 but also the first throttle valve 2 are operated, thereby realizing the relative opening degree control according to the operating amount of the pedal 9. In other words, the operating amount of the pedal 9 is converted into an accelerator pedal operating amount signal AC by the acceleration sensor 29. This signal AC is supplied to the calculation/controlling unit 27, by which the rotation angle RA of the first throttle valve 2 is determined in correspondence to the pedal operating amount. In this case, this rotation angle is obviously decided in consideration of the relative rotation angle between the rotation angles of the second and first throttle valves 4 and 2.

Consequently, the rotation command signal D for the first throttle valve 2 is finally generated by the unit 27 based upon not only the rotation angle of the first throttle valve 2 but also other sensor data and the actuator 13 controls the rotation of the first throttle valve 2 on the basis of the signal D.

Figure 5:
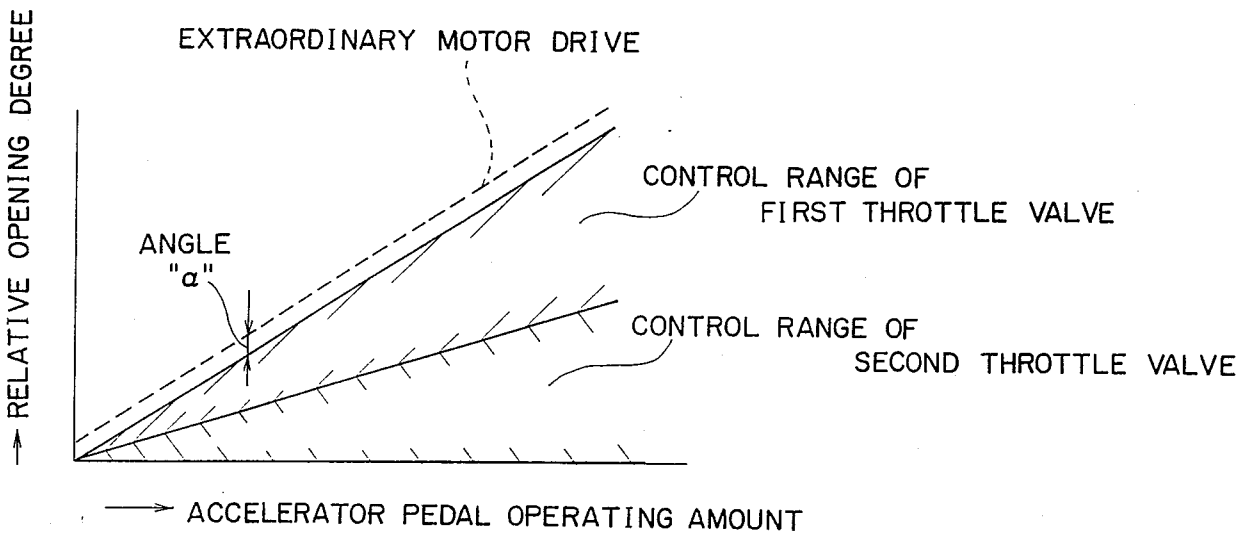
FIG. 5 is a graphic representation for explaining the relationship between the relative opening degree and accelerator pedal operating amount.

FIG. 5 is a graphic representation of the characteristic relationship among the control ranges of the first and second throttle valves 2 and 4 and the relative opening degree when the motor abnormally rotates as described above.

In FIG. 5, the ordinate denotes a relative opening degree between the first and second throttle valves 2 and 4 whereas the abscissa indicates an operating amount of the accelerator pedal 9. As will be obvious from these characteristic representations, the motor-sided gear 15 (motor-sided contact 24) is constructed such that it cannot be rotated at an angle more than the maximum rotation angle of the pedal-sided gear 20. In other words, during such malfunction of the calculation/controlling unit 27, the motor-sided contact 24 never exceed over the pedal-sided contact 22, as viewed in the rotation direction indicated by the arrow 36 of FIG. 4D. On the other hand, the minimum separating angle $\alpha$ between the contacts 22 and 24 is specified on the basis of the relative opening degree characteristics when the motor abnormally rotates and the control range of the first throttle valve 2.

MODIFICATIONS OF RELATIVE POSITION LIMITING MEANS

Another embodiment of the relative position limiting means 50 as one of the major features of the throttle valve controlling apparatus 100 of the invention will now be described with reference to FIGS. 6 and 7.

Figure 6:
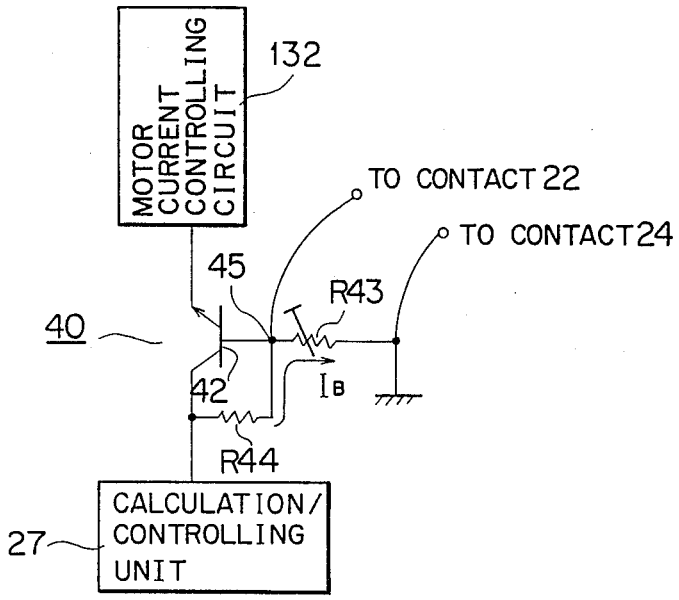
FIG. 6 is a circuit diagram of a transistor switch of the relative position limiting means shown in FIG. 1.

First, FIG. 6 shows a transistor switch 40 constructing a part of the relative position limiting means 50 for the first and second throttle valves 2 and 4. The transistor switch 40 corresponds to the electromagnetic relay 25 shown in FIG. 1. The switch 40 comprises an NPN transistor 42, a base resistor R43, and a base-collector resistor R44. One end of the base resistor R43 is grounded. A junction 45 between the other end of the base resistor R43 and one end of the base-collector R44 is connected to the pedal-sided contact 22 (see FIG. 3). One end of the base resistor R43 is connected to the motor-sided contact 24 (see FIG. 3).

Since the circuit itself of the transistor switch 40 is a well-known switching circuit, a simple description will now be useful.

First, the semi-fixed type variable resistor R43 is properly adjusted and a bias current $I_B$ flows from the calculation/controlling unit 27 to the ground through the base-collector resistor R44 and variable resistor R43, so that a proper base-bias voltage is applied to the NPN transistor 42. Therefore, the NPN transistor 42 is turned ON under the normal operating state and the rotation command signal D can be supplied from the unit 27 to the motor current controlling circuit 132 through a collector-emitter path of the transistor 42.

Next, when the unit 27 is brought into malfunction as mentioned above, the motor-sided contact 24 electrically touches the pedal-sided contact 22 to thereby short-circuit the base resistor R43 and enable the base of the NPN transistor 42 to be grounded. Thus, the transistor 42 is turned OFF and the supply of the rotation command signal D is interrupted from the unit 27 to the actuator 13.

Figure 7:
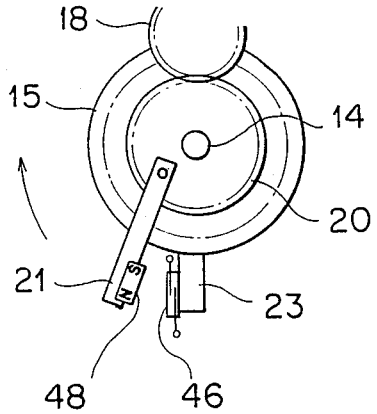
FIG. 7 schematically illustrates the modified first and second contacts employed in the apparatus shown in FIG. 1.

Next, FIG. 7 shows a modification of the pedal-sided and motor-sided contacts. In this example, in place of the mechanical contacts, a reed switch 46 and a permanent magnet 48 are respectively fixed to the second and first arms 23 and 21.

On the other hand, according to the throttle valve controlling apparatus of the invention, the invention is not limited to only the foregoing embodiments but many modifications and variations are obviously possible.

For instance, in the preferred embodiment shown in FIG. 1, the first throttle valve 2 has been controlled by the electrically controlled actuator 13 whereas the second throttle valve 4 has been controlled by the accelerator pedal 9. Conversely, the first and second valves 2 and 4 can be also controlled by the pedal 9 and actuator 13 respectively. In this case, it is necessary to set such that the motor-sided contact does not overrun the pedal-sided contact as viewed in its rotating direction.

On the other hand, in the foregoing embodiments, the target valve rotation angle $\theta_T$ of the first throttle valve 2 has been calculated by the calculation/controlling unit 27 on the basis of the output signals from the acceleration sensor 29 and drive condition sensors 30. Alternatively, the rotation command signal may be also derived by calculating the target valve rotation angle $\theta_T$ on the basis of only the accelerator pedal operating amount signal from the acceleration sensor 29.

As described above, according to the present invention, the rotational position of one throttle valve device controlled by the electrically controlled actuator with respect to the rotational position of the other throttle valve device controlled by the mechanical driving means (accelerator pedal) has been limited within a predetermined range. Therefore, even if the electrically controlled actuator or calculation/controlling unit becomes malfunction, the runaway of the vehicle itself can be prevented. The safety on driving a vehicle is high. Moreover, even after such an abnormal state occurred, the driving of the vehicle can be still continued.

What is claimed is:

1. A throttle valve controlling apparatus for an automobile comprising:

throttle valve means including a first throttle valve and a second throttle valve relatively rotatable to said first throttle valve, for controlling a flow of an air/fuel mixture to an engine of the automobile;

rotating means mechanically coupled to an accelerator pedal, for relatively rotating said first throttle valve with respect to said second throttle valve;

first return spring means for biasing said first throttle valve so as to set the same to a first closed position of said first throttle valve when said accelerator pedal is released;

rotation angle sensor means for sensing an actual rotation angle of said second throttle valve to output a rotation angle signal;

calculation/controlling means for producing a rotation command signal representative of a target rotation angle for said second throttle valves, determined by operation of said accelerator pedal;

electrically controlled actuator means for relatively rotating said second throttle valve with respect to said first throttle valve in response to said rotation command signal derived from said calculation/controlling means in such a manner that deviation between said target rotation angle and actual rotation angle becomes zero;

second return spring means for biasing said closed position of said second throttle valve; and, relative position limiting means interposed between said electrically controlled actuator means and said calculation/controlling means, for limiting a relative position between said first and second throttle valves within a predetermined rotation range in such a manner that when malfunction of said calculation/controlling means is detected by checking said relative position in said relative position limiting means, supply of said rotation command signal from said calculation/controlling means via said relative position limiting means to said electrically controlled actuator means is interrupted.

2. A throttle valve controlling apparatus as claimed in claim 1, further comprising:

engine condition/drive condition sensor means for detecting conditions of the engine and also the automobile's drive to produce an engine condition detecting signal and a drive condition detecting signal, whereby said target rotation angle for said second throttle valve is determined by said operation of the accelerator pedal in conjunction with said engine condition detecting signal and said drive condition detecting signal.

3. A throttle valve controlling apparatus as claimed in claim 1, wherein said electrically controlled actuator means includes:

a DC (direct current) motor; and a motor current controlling circuit for controlling motor current of said DC motor in response to said rotation command signal.

4. A throttle valve controlling apparatus as claimed in claim 1, wherein said second throttle valve is rotatably stored within an air-intake tube of the engine and has a cylindrical path formed therein for passing the air/fuel mixture to the engine, and said first throttle valve is a disk shape and coaxially provided within said cylindrical path of said second throttle valve so as to control a flow quantity of said air/fuel mixture in conjunction with said second throttle valve.

5. A throttle valve controlling apparatus as claimed in claim 4, wherein said second throttle valve further includes a cylindrical axial part supported by said air-intake tube and coupled to a first gear, and said second return spring means is a coil-shaped spring one end of which is fixed on said air-intake tube and the other end of which is fixed on said first gear, said first gear being meshed with a second gear so as to be coupled with said DC motor; a valve shaft is integrally formed with said first throttle valve with penetrating through said second throttle valve, one end of said valve shaft being connected to a third gear and the other end thereof being biased by said first return spring means; and a fourth gear is meshed via an intermediate gear with said third gear, whereby said fourth gear is rotated in cooperation with said first throttle valve by said accelerator pedal.

6. A throttle valve controlling apparatus as claimed in claim 5, further comprising:

a first arm one end of which is connected to said fourth gear, whereby said first arm is rotated while said first throttle valve is rotated;

a second arm one end of which is connected to said second gear, whereby said second arm is rotated while said second throttle valve is rotated;

a first contact connected to the other end of said first arm; and, a second contact connected to the other end of said second arm, whereby said first contact is electrically in contact with said second contact when said calculation/controlling means is brought into malfunction.

7. A throttle valve controlling apparatus as claimed in claim 6, wherein said rotation position limiting means is an electromagnetic relay having normally-closed contacts interposed between said calculation/controlling means and electrically controlled actuator means, and a relay coil connected via an energizing DC source to said first and second contacts.

8. A throttle valve controlling apparatus as claimed in claim 6, wherein said rotation position limiting means is a transistor switch having an NPN transistor, a collector-to-base resistor, and a base resistor one end of which is grounded; a collector-to-emitter current path of said NPN transistor is interposed between said calculation/controlling means and said electrically controlled actuator means; both ends of said base resistor are connected to said first and second contacts respectively, whereby when said first contact is electrically in contact with said second contact, during malfunction of said calculation/controlling means, a base of said NPN transistor is grounded, thereby interrupting said collector-to-emitter current path thereof.

9. A throttle valve controlling apparatus as claimed in claim 5, further comprising:

a first arm one end of which is connected to said fourth gear, whereby said first arm is rotated while said first throttle valve is rotated;

a second arm one end of which is connected to said second gear, whereby said second arm is rotated while said second throttle valve is rotated;

a reed switch mounted on the other end of said first arm; and a permanent magnet mounted on the other end of said second arm, whereby said reed switch is magnetically turned on in conjunction with said permanent magnet when said calculation/controlling means is brought into malfunction.

* * * * *